United States Patent [19]

Culver

[11] 4,333,385

[45] Jun. 8, 1982

[54] GUN SIGHTING APPARATUS

[76] Inventor: W. Jay Culver, 250 17 Mile Rd., Kent City, Mich. 49330

[21] Appl. No.: 176,223

[22] Filed: Aug. 7, 1980

[51] Int. Cl.[3] ..... F41F 25/00

[52] U.S. Cl. ..... 89/37 BA; 73/167

[58] Field of Search ..... 42/94; 89/37 BA; 73/167

[56] References Cited

U.S. PATENT DOCUMENTS

| | | | |
|---|---|---|---|
| 499,315 | 6/1893 | Borchardt | 42/94 |
| 882,988 | 3/1908 | Aloyos et al. | 42/94 |
| 2,817,233 | 12/1957 | Dower et al. | 73/167 |
| 3,358,504 | 12/1967 | Freebairn | 89/37 BA |
| 3,805,608 | 4/1974 | Schmidt et al. | 89/37 BA |

FOREIGN PATENT DOCUMENTS

| | | | |
|---|---|---|---|
| 81822 | 5/1953 | Norway | 89/37 BA |

*Primary Examiner*—Charles T. Jordan

*Attorney, Agent, or Firm*—Blanchard, Flynn, Thiel, Boutell & Tanis

[57] ABSTRACT

An apparatus for adjusting gun sights, particularly telescopic sights on rifles, wherein the rifle is mounted upon and rigidly clamped to, a gun support which is slidably supported upon a base structure so that the rifle can move a short distance parallel with the axis of the gun barrel when the gun is fired without damaging the apparatus or the gun because of the force of the recoil. The gun support includes a pair of spaced cradles, one of which supports the barrel and the other of which supports the butt. The barrel-supporting cradle is vertically adjustable and clamp means are provided for engaging the barrel and the butt stock adjacent said cradles for firmly holding the rifle with respect to the support.

This invention relates in general to an apparatus for adjusting the sights of a gun and, more particularly, to a gun sighting apparatus adapted to adjust the telescopic sight on a rifle.

6 Claims, 9 Drawing Figures

GUN SIGHTING APPARATUS

BACKGROUND OF THE INVENTION

Many devices have been developed for adjusting gun sights but, generally speaking, they are difficult to use, produce inaccurate results, risk damage to the gun or fail in some other respect to be completely satisfactory.

Accordingly, a primary object of this invention has been the provision of a completely satisfactory and extremely accurate gun sighting apparatus capable of use with a wide variety of makes and models of rifles without risking damage thereto and capable of use and operation by any person capable of using the gun the sight of which is being adjusted.

A further object of this invention has been the provision of a gun sighting apparatus, as aforesaid, which is adequately sturdy in structure and capable of absorbing the shock of recoil when the gun held thereby is fired.

Other objects and purposes of this invention will become apparent upon reading the following specification and examining the accompanying drawings, in which.

Figure 1:
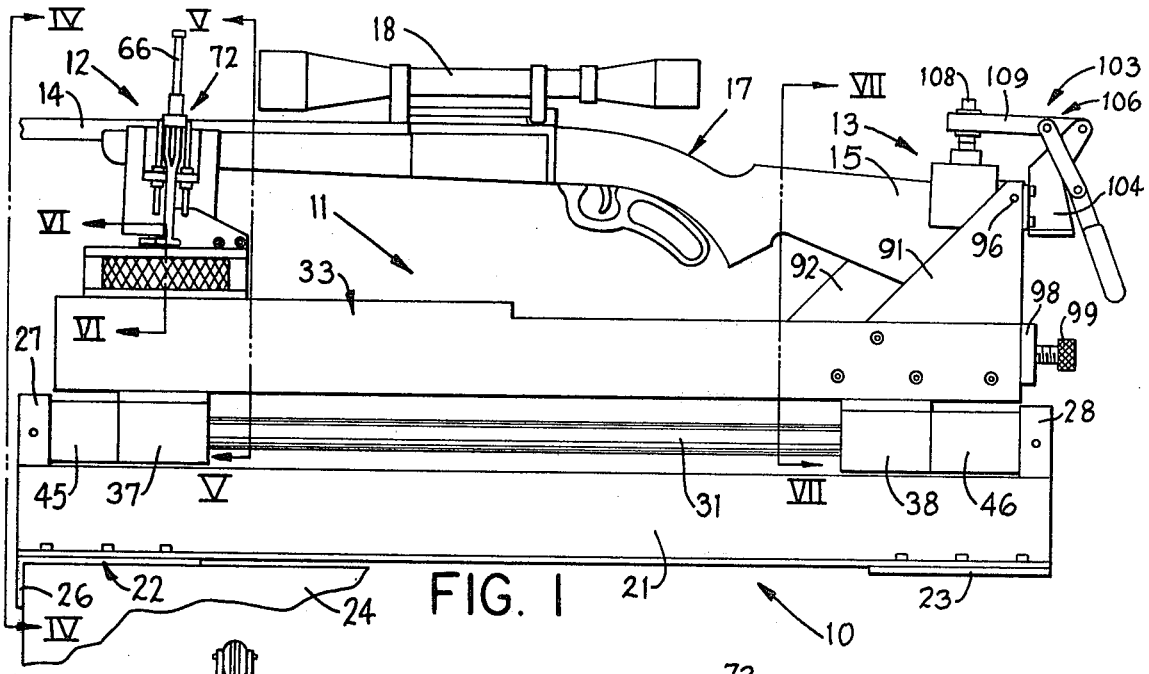
FIG. 1 is a side elevational view of the apparatus embodying the invention with a rifle mounted thereon.
Figure 3:
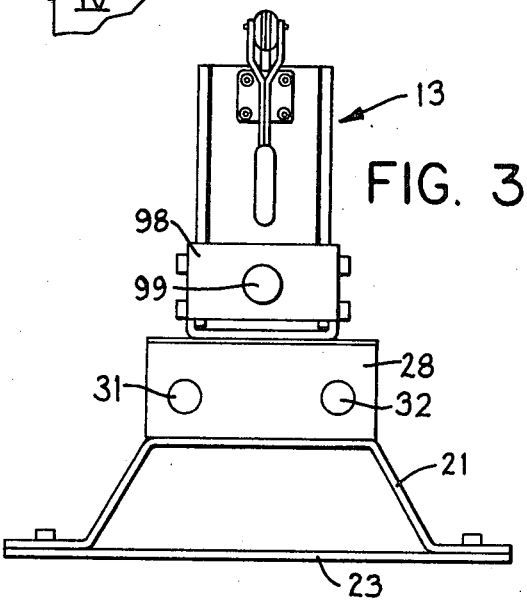
FIG. 3 is a rear end elevational view of said apparatus.
Figure 2:
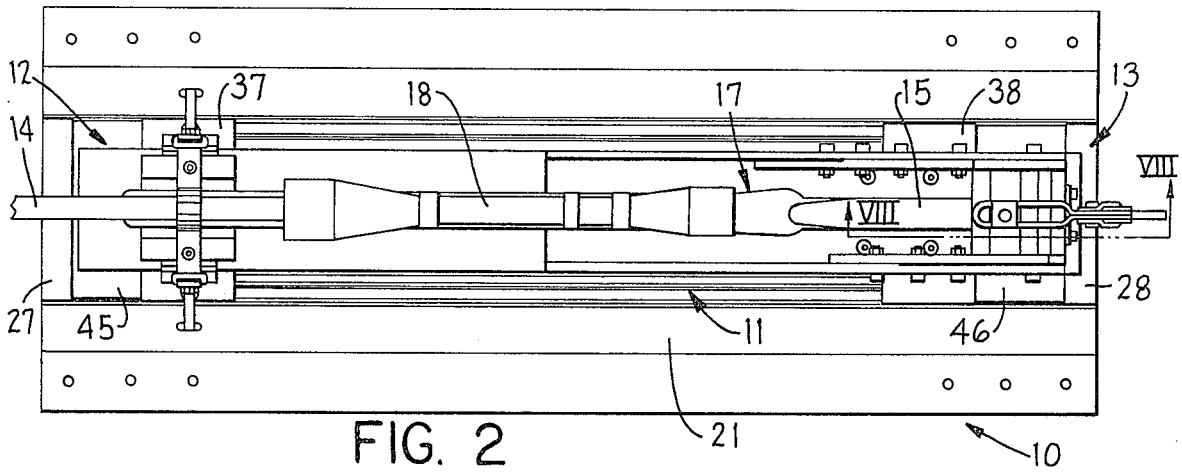
FIG. 2 is a top plan view of said apparatus including said rifle.

For convenience in description, the terms "front" and "rear", or derivatives thereof, shall have reference to the left and right ends, respectively, of the apparatus as appearing in FIGS. 1 and 2.

SUMMARY OF THE INVENTION

The objects and purposes of the invention have been met by providing a gun support having cradle means for mounting a gun, particularly of the rifle type, upon said gun support which in turn is slidably supported upon a base structure so that the gun support and the gun thereon can move in a direction substantially parallel with the axis of the gun barrel when the gun is fired. Resilient means is provided for absorbing the shock of recoil when the gun is fired, such resilient means including padding between the gun support means and the stock of the gun as well as shock absorbing means disposed between the gun support and the base structure.

DETAILED DESCRIPTION

A preferred embodiment of the invention, as appearing in FIGS. 1, 2, 3 and 4, includes an elongated base structure 10 upon which a gun support 11 is mounted for slidable movement lengthwise thereof. Front and rear gun cradles 12 and 13 are secured upon the gun support 11 for removable engagement with the gun barrel 14 and butt stock 15, respectively.

The gun 17 is a rifle having a telescopic sight 18 adjustably mounted thereon in a substantially conventional manner. Thus, the telescopic sight can be adjusted both vertically and laterally.

The base structure 10 includes an inverted channel 21 having cross braces 22 and 23 secured to and extending between the front and rear ends, respectively, thereof. Said cross braces may in turn be mounted upon means such as a table 24 (FIG. 1) of any conventional type. A flange 26 on the front edge of the cross brace 22 is engageable with the front edge of the table 24 to prevent rearward movement of the base structure relative to the table.

A pair of abutments 27 and 28 are secured respectively to the upper surface of the channel 21 adjacent the front and rear ends thereof, respectively. A pair of spaced and parallel slide rods 31 and 32 extend between and are rigidly secured, respectively, to the front and rear abutments 27 and 28 so that they are preferably in substantially the same horizontal plane and are spaced from said channel 21.

The gun support 11 has an elongated substantially tubular member 33 which is preferably rectangular in cross section. The rearward portion of the upper wall 34 of the tubular member 33 is removed for reasons appearing hereinafter.

Figure 5:
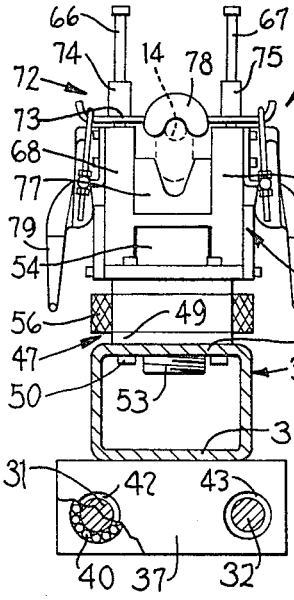
FIG. 5 is a sectional view taken along the line V—V in FIG. 1.
Figure 7:
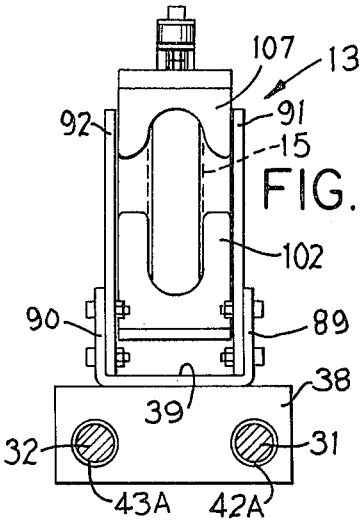
FIG. 7 is a sectional view taken along the line VII—VII in FIG. 1.

A pair of sliders 37 and 38, FIGS. 5 and 7, are rigidly secured to the lower wall 39 of the tubular member 33 near the front and rear ends thereof, respectively. The slider 37 has a pair of parallel openings 42 and 43, FIG. 5, through which the rods 31 and 32 extend. Plural races of antifriction bearings, such as those shown at 40 in FIG. 5, are disposed within the openings 42 and 43 for engaging the rods 31 and 32 and thereby supporting the sliders, hence the structure mounted thereon, upon the rods 31 and 32 for movement lengthwise thereof.

The slider 38 (FIG. 7) has openings 42A and 43A through which the rods 31 and 32, respectively, are slidably received. The openings 42A and 43A contain plural sets of antifriction bearings, not shown, as discussed above with respect to the bearings 40 in the slider 37.

The remote surfaces of the sliders 37 and 38 are spaced from each other a distance somewhat less than the distance between the opposing surfaces of the abutments 27 and 28. A pair of foamed plastic cushions 45 and 46 are mounted upon the rods 31 and 32 adjacent the abutments 27 and 28, respectively, in order to substantially fill the spaces between the abutments and the adjacent sliders 37 and 38, respectively. It has been found that these cushions act more effectively in absorbing recoil when the gun is fired than do other types of resiliently flexible means such as springs. In particular, the cushions absorb the shock of recoil and dampen any oscillations which might otherwise occur. The amount of cushion and the corresponding space provided therefor may vary somewhat depending upon the power of the gun being tested.

Figure 6:
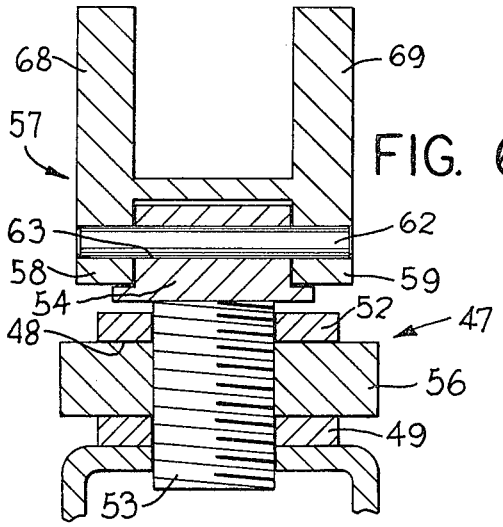
FIG. 6 is a sectional view taken along the line VI—VI of FIG. 1.

The front cradle 12 (FIGS. 4, 5 and 6) is comprised of a rectangular nut housing 47 having a rectangular, horizontal opening 48 therethrough. The bottom wall 49 of the housing 47 is secured, as by bolts 50, to the upper wall 34 of the tubular member 33 near the front end thereof. The upper wall 52 of housing 47, the bottom wall 49 thereof and said upper wall 34 of member 33 are provided with coaxial openings through which the threaded shank 53 of the post 54 is slidably received. A nut 56 is disposed within the opening 48 and threadedly engages the shank 53 whereby rotation of the nut 56 in the appropriate direction will effect upward and downward movement of the shank 53, hence the post 54. The nut 56 extends laterally beyond the outer surface of the housing 47 so that it can be manually engaged for effecting rotation thereof.

An H-shaped cushion support 57 has a pair of lower flanges 58 and 59 which are disposed upon opposite sides of the upper end of the post 54. A pivot pin 62 is mounted at its opposite ends within the flanges 58 and 59 and the central portion of said pin is rotatably supported within an appropriate opening 63 in said post upper end. Thus, the cushion support 57 is able to pivot frontwardly and rearwardly about the axis of pivot pin 62.

A pair of vertical and parallel guide rods 66 and 67 are rigidly secured to and extend upwardly from the upper flanges 68 and 69, respectively, of the cushion support 57. A cushion support clamp 72 has a horizontally disposed clamp plate 73 upon which the parallel sleeves 74 and 75 are secured for sliding engagement with the rods 66 and 67, respectively.

Figure 4:
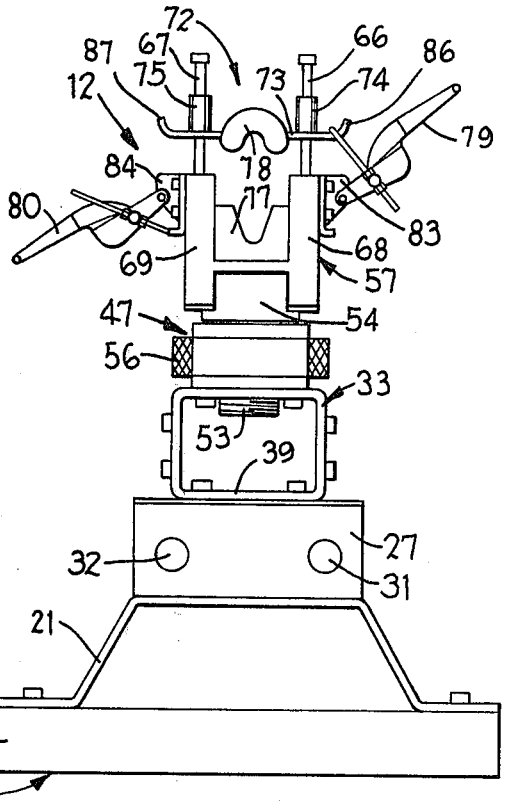
FIG. 4 is a front end elevational view of said apparatus.

A resiliently flexible and substantially V-shaped lower cushion 77 preferably made of rubber, is mounted within the cushion support 57 between the upper flanges 68 and 69 thereof (FIGS. 4 and 5). A resiliently flexible, arcuate upper cushion 78, preferably made from rubber, is mounted upon the clamp plate 73. The lower cushion 77 is shaped to engage the front end of the gun stock beneath the barrel and the upper cushion 78 is shaped to engage the upper portion of the gun barrel.

A pair of over center toggle devices 79 and 80 are mounted by brackets 83 and 84, respectively, upon the remote surfaces of the flanges 68 and 69, respectively, for engagement with the outer upwardly curved ends 86 and 87 of the clamp plate 73 for urging the cushion support clamp 72 downwardly into firm holding engagement with the barrel 14 (FIG. 5) of the gun.

The rear gun cradle 13 (FIGS. 1, 2 and 7) has a pair of spaced, vertical and parallel side plates 91 and 92 which are preferably rigidly secured to the side walls 89 and 90 of the tubular member 33. An L-shaped butt support 93 has a substantially vertical flange 94 (FIG. 8) which is pivotally supported near its upper end by pivot pin means 96 (FIG. 1) upon and between the side plates 91 and 92 for pivotal movement around a substantially horizontal axis transverse of the lengthwise extent of the slide rods 31 and 32. The horizontal flange 97 extends frontwardly from the lower edge of the vertical flange 94 and is spaced upwardly from the lower wall 39 of the tubular member 33.

A cross bar 98 is rigidly secured to and extends between the rearward, lower edges of the side plates 91 and 92. An adjustment screw 99 is threadedly received through an appropriate threaded opening in the bar 98 for engagement with the lower end of the vertical flange 94 whereby said vertical flange, hence the horizontal flange 97, may be adjustably held in selected positions with respect to the cross bar 98. This adjustment is provided because the shape and angle of the shoulder engaging end of the gun butt varies from gun make to gun make. Thus, it is desirable to be able to adjust the position of the butt support 93 to the variations in the gun butt shape and/or angle of the various guns.

A gun butt cushion 102 (FIGS. 7 and 8) has a bottom wall, a rear wall and two side walls for snugly engaging the lower portion of the gun butt 15.

A cushion support clamp 103 (FIGS. 1, 3 and 8) is comprised of a bracket 104 mounted upon the rear upper side of the vertical flange 94 and an over center toggle device 106 mounted upon said bracket and supporting a downwardly opening U-shaped cushion 107 engageable with the upper portion of the gun butt 15 (FIG. 7). The cushion 107, which is preferably fabricated from a resiliently flexible material like rubber, is connected by an adjustment bolt 108 to the arm 109 of the toggle device 106.

Figure 9:
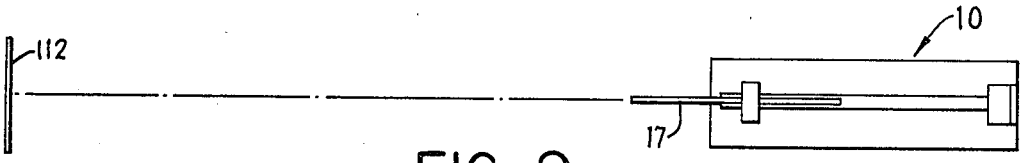
FIG. 9 is a top plan view of said apparatus, said rifle and a target.

FIG. 9 illustrates schematically the apparatus of the invention supporting a gun 17 aimed at a target 112.

OPERATION

Although the operation of the apparatus of the invention will be apparent from the foregoing description, further details thereof are set forth hereinafter. The apparatus of the invention is preferably placed upon a table or similar support 24 in a substantially horizontal position. The gun 17 is placed within the cradles 12 and 13, preferably so that the barrel 14 thereof is in a horizontal position. Adjustment of the barrel can be affected by manually turning the nut 56. By manually adjusting the screw 99 on the rear cradle, the butt support 93 is adjusted to a proper position for engaging the rearward end of the gun butt 15.

The toggle devices 79 and 80 are then moved from their unclamping positions of FIG. 4 into their clamped positions of FIG. 5, in a substantially conventional manner, whereby the gun barrel and adjacent portion of the gun stock are firmly clamped and gripped between the lower cushion 77 and upper cushion 78.

Figure 8:
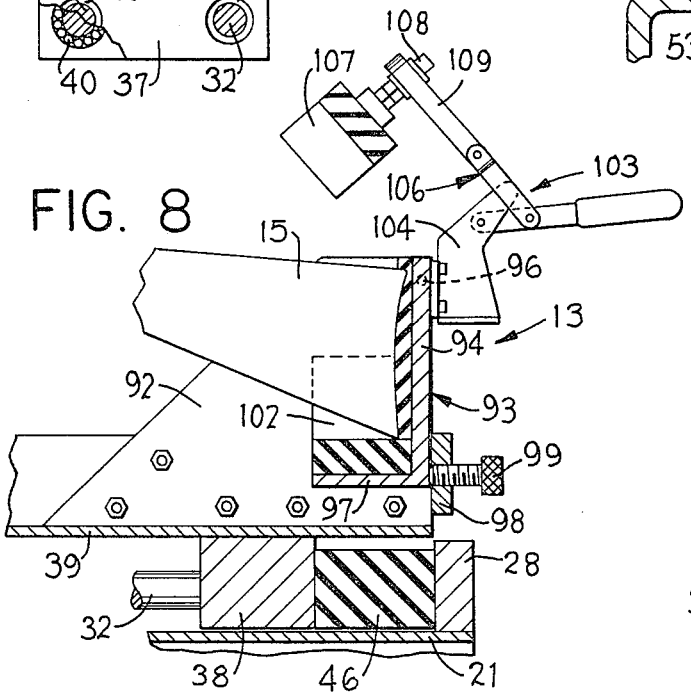
FIG. 8 is a sectional view taken along the line VIII—VIII in FIG. 2.

The toggle device 106 is thereafter operated to move the cushion 107 from its FIG. 8 position into its FIG. 7 position wherein the gun butt is firmly clamped between the cushions 102 and 107. The gun is then loaded with a cartridge and fired at the target 112. The gun sight 18 is then adjusted so the cross hairs thereof are centered upon the opening in the target 112 made by the projectile. If a double check is desired, the target can be moved slightly transversely of the line of sight and the gun can then be fired again to make another opening therein. The cross hairs of the sight should be on the new opening. However, if not, further slight adjustment can be made.

The gun can then be quickly and readily removed from the cradles 12 and 13 by simply releasing the toggle devices 79, 80 and 106.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. An apparatus for adjusting the sights of a gun having an elongated barrel and a butt, comprising:

elongated base means;

elongated rod means rigidly secured to and extending lengthwise of said base means and having a pair of spaced abutment means;

elongated gun support means having slide means secured thereto and mounted upon said rod means for movement lengthwise thereof, said slide means being disposed between and spaced from said abutment means;

resiliently flexible, substantially solid state means disposed snugly between each abutment means and the adjacent slide means;

a pair of spaced cradle means mounted upon said gun support means and arranged for supporting said gun barrel and said gun butt; and manually operable clamp means for engaging said barrel and said butt for firmly holding them rigidly within said cradle means.

2. An apparatus according to claim 1, wherein said abutment means comprises a pair of blocks rigidly mounted upon said base means near the opposite ends thereof;

wherein said rod means comprises a pair of spaced parallel and cylindrical bars extending between said abutment means; and wherein said slide means includes ball anti-friction means for supporting said slide means upon said rod means.

3. An apparatus according to claim 2, wherein said resilient means comprises foamed plastic blocks capable of compression and having sufficient memory to return to their uncompressed condition after being compressed.

4. An apparatus according to claim 1, wherein said sights include a telescope;

wherein said cradle means supporting said barrel is vertically adjustable relative to said gun support means; and wherein said cradle means for said barrel is pivotally mounted with respect to said gun support means for movement around an axis transverse of the lengthwise extent of said gun support means.

5. An apparatus according to claim 4, wherein said cradle means for support of said butt comprises a pair of upstanding spaced side walls between which said butt is receivable;

an end wall pivotally supported near its upper end upon and between said side walls and having padding means on the inner surface thereof engageable by said butt; and manually adjustable means mounted upon said gun support and engageable with the lower end of said end wall for holding said end wall in selected positions.

6. An apparatus according to claim 4, wherein said clamp means comprises first cushion means engageable with said butt and first actuating means connected between said first cushion means and said cradle means for said butt for firmly holding said butt within said cradle means; and second cushion means engageable with said barrel and a pair of toggle means mounted upon said cradle means supporting said barrel and engageable with said second cushion means for firmly holding said second cushion means against said barrel.

* * * * *